United States Patent [19]

Humphrey et al.

[11] 4,084,914

[45] Apr. 18, 1978

[54] SELF-ERECTING HIGHWAY GUIDE POST

[76] Inventors: William D. Humphrey, 909 Riverview Ave.; Allen Becker, 101 Hillcrest Dr., both of Selah, Wash. 98942

[21] Appl. No.: 763,239

[22] Filed: Jan. 28, 1977

[51] Int. Cl.[2] ..... E01F 9/00

[52] U.S. Cl. ..... 404/10; 40/608; 52/153; 256/1

[58] Field of Search ..... 404/10, 9; 52/153, 154; 256/1, 13.1; 40/145 A, DIG. 2

[56] References Cited

U.S. PATENT DOCUMENTS

| | | | |
|---|---|---|---|
| Re. 10,366 | 8/1883 | Oliver | 52/154 |
| Re. 13,202 | 2/1911 | Atchison | 52/154 |
| 1,089,459 | 3/1914 | Booth | 52/154 |
| 1,426,044 | 8/1922 | Clum | 52/155 |
| 1,578,612 | 3/1926 | Scanlan | 52/155 |
| 3,091,997 | 6/1963 | Byrd | 404/10 |
| 3,371,647 | 3/1968 | Shopbell | 404/10 X |
| 3,606,222 | 9/1971 | Howard | 52/153 X |
| 3,709,112 | 1/1973 | Ebinger | 404/10 |
| 3,820,906 | 6/1974 | Katt | 404/10 X |

*Primary Examiner*—Nile C. Byers
*Attorney, Agent, or Firm*—David H. Deits; Roy E. Mattern, Jr.; Kenneth S. Kessler

[57] ABSTRACT

A self-erecting highway guide post for insertion in the ground is constructed in the form of a resilient plastic channel having a substantially flat center surface flanked on either side by a pair of flat side portions which are joined at an obtuse angle to the center portion by curved surfaces. A second, arcuately cross-sectioned channel is attached by fasteners through the center portions of each channel to the rear of the first channel. The rear, concave surface of the arcuate channel is directed toward the rear surface of the first channel and lies within its side portions. Such a configuration results in a self-erecting highway guide post when one end is imbedded in the ground to denote the margin of a highway. When the post is struck the curved portions flatten allowing the post to bend when run over by a vehicle and to recurve once the vehicle passes to re-erect the post. The self-erecting post may include features including integrally constructed barbs or holes to prevent removal of the channel once inserted in the ground, reflective elements attached to the face of the channel such as reflective tape, construction from a thermo-plastic polycarbonate resin, and a construction in which the curved portions joining the sides to the central portion are uniformly curved. Other embodiments may omit the second arcuately cross-sectioned channel or may be of the two member construction with the first channel being arcuately cross-section.

15 Claims, 8 Drawing Figures

SELF-ERECTING HIGHWAY GUIDE POST

BACKGROUND OF THE INVENTION

The highway system as it exists today requires use of some system to help identify areas of the highway on which autos should or should not drive. The most common example is the shoulder area of the highway which is sloped and soft and separates the driving surface from the hazardous off-road ditches and the like.

Many systems have been offered which will visibly and audibly make drivers aware of the safe boundary lines.

One such system involves the use of tubular markers. One such device is illustrated by the Ebinger patent #3,709,112.

The Pellowski patent #3,362,305 illustrates the use of an arcuate steel strip which has one end embedded in a well of hardenable material and is flanked on either side by markers which have grooves shaped to receive the arcuate strip as it is passed over and bent by a vehicle.

Other guide post systems of either a temporary or permanent nature are illustrated by the following patents: Byrd U.S. Pat. NOS. 3,212,415 and 3,091,997; Abrams 3,380,428; and Mahoney 3,340,779.

Most systems have been discarded in favor of a steel post with a reflector on top. This system, too, however, has proven to have serious disadvantages. The steel posts themselves do not offer visibility and depend almost entirely on their reflectors for visible appearance. Furthermore, they become permanently damaged when struck by an auto then have to be replaced. This attrition rate is very high and represents a significant cost in highway maintenance budgets. The steel posts do great amounts of damage to vehicles which come in contact with them.

Highway guide posts to be of greatest value would be one which does not require complicated or expensive installation. It should have a high degree of visibility, be durable, self-erecting, and generate a noise when struck by a vehicle, but would not be damaged by the vehicle or damage the striking vehicle.

The invention described is designed to meet the desirable guide post features outlined above.

SUMMARY OF THE INVENTION

A highway guide post marker for use in demarking the traveled portions of the highway and separating and segregating them from the untraveled or unsafe portions of the highway is provided. The self-erecting highway guide post in its preferred form is in the form of a channel having a flat front surface flanked by side portions which are also flat and are disposed in an obtuse angle to the front face. The side portions are connected to the front portion by curved corner portions. A second, arcuately cross-sectional channel is attached by fasteners through the center of each channel to the rear of the first channel. The rear concave surface of the arcuate channel is directed toward the rear surface of the first channel and its edges lie centrally within the curved corner portions.

The plastic material from which the post is made may be selected in a color to present a high degree of visibility. The plastic selected should have good durability. The preferred material from which the post can be made is a thermo-plastic, polycarbonate resin which characteristically has a high impact resistance.

Reflective elements such as plastic multifaceted reflectors of any desired color or reflective tapes having adhesive backing may be attached to the surfaces of the post to enhance visibility. Barbs may be formed integrally on the portion of the stake which is to be inserted in the ground or holes made in this portion to prevent the easy removal of the stakes. It is further advantageous that the first channel be constructed to have a uniform thickness and its curved portions be uniformly curved while the arcuate channel has a thinner central portion.

In use such a high visibility self-erecting highway guide post has its lower end embedded in the road surface with the flat face directed toward the oncoming traffic. When a vehicle strikes the face of the stake, sections of each of the channels will flatten allowing the stake to bend along a fold line. As the vehicle passes over the stake the stake repeatedly strikes the typically uneven surfaces of the underside of the vehicle causing a noise awaking a sleeping or inattentive driver. After the vehicle passes over the stake the curved portions recurve causing the guide post to re-erect. Such a highway guide post is easy to install, doesn't require complicated or expensive installation procedures.

In other embodiments the first channel section which has the flat face is utilized alone. In a still further embodiment both channel members are utilized with both having arcuate cross-sections.

DETAILED DESCRIPTION OF THE INVENTION

Introduction

Highway guide posts are provided along roadways to mark the boundaries of the traveled roadway. A self-erecting guidepost is provided which is not permanently damaged when struck by a vehicle. The guidepost will re-erect itself after the vehicle has passed over it.

Preferred Embodiment

The preferred form of the guidepost 20 as illustrated in FIGS. 1, 2, 3, and 8 consists principally of a first or front channel 22 and a second, damper channel 24 connected to the rear of the first channel by fasteners, such as the blind rivets 26 illustrated.

Figure 3:
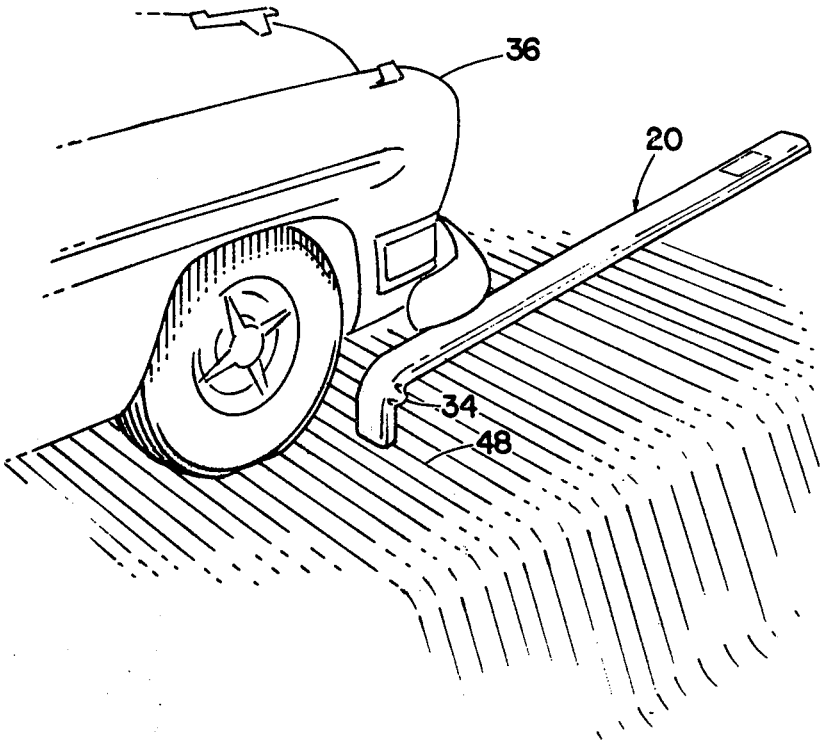
FIG. 3 is a perspective view of a vehicle striking the guidepost illustrating its ability to bend.

More specifically, the front channel 22 consists of an elongated channel of a flexible, impact resistant plastic material. Structurally it has an elongated substantially flat center portion 28 flanked by substantially flat side portions 30 which are joined at an obtuse angle to the center portion by curved corner portions 32 preferably of a uniform curvature. The side portions 30, preferably, are substantially narrower than the center portion. They provide rigidity and help to maintain the channel in a substantially linear configuration. The preferred material from which the channel 22 is constructed is a thermoplastic, polycarbonate resin. Such a material has the desirable characteristics for this application of high impact resistance, low water absorption, chemical resistance, stain resistance, stability under ultraviolet light, and temperature resistance. The product marketed by the General Electric Company, One Plastics Ave., Pittsfield, Mass. under the name LEXAN is an example of such material. The front channel 22 is preferably of a uniform thickness which is less than 0.140 inch. Such a thickness provides sufficient rigidity while providing the necessary flexibility to avoid significant material damage due to stress at the bend sites 34 when struck by a vehicle 36 as shown in FIG. 3. Preferably the polycarbonate is extruded to longitudinally form the channel to give it a high resistance to damage caused by the transverse folding of the channel when struck. Preferably the upper corners 38 of the channel are rounded to avoid sharp points. Preferably a reflector element such as a section of reflective tape 40 of the type having an adhesive backing is attached to the face 42 of the guidepost 20. The lower end 44 may be pointed or blunt. It preferably has several holes 46 through it. These holes are provided to help retain the post in the ground 48 when this lower end is embedded in it. Preferably the post is placed by digging a hole in the ground, inserting the lower end 44 of the guide post 20, and then backfilling the hole.

Figure 1:
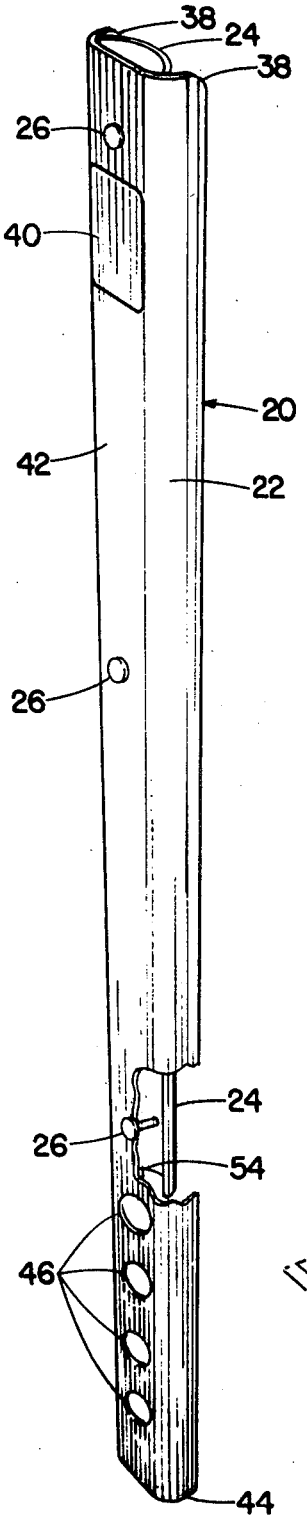
FIG. 1 is a perspective view of the preferred form of the guidepost.
Figure 2:
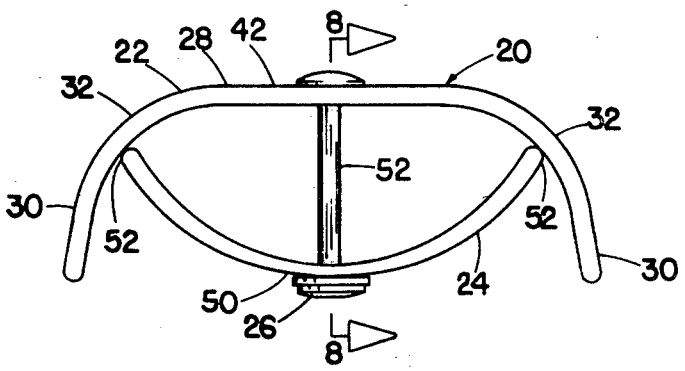
FIG. 2 is a transverse sectional view showing the cross-section of the preferred embodiment.

The damper channel 24 preferably has an arcuate cross-section, as illustrated in FIG. 2. Preferably this channel 24 is thinner in the center 50 than toward its edges 52. This promotes the tendency of the channel to remain in the arcuate shape when it is, as it is preferred, constructed from the same longitudinally extruded thermoplastic, polycarbonate resin as the first channel 22. It is preferably sized so that its edges 52 contact the corner portions 32 of the first channel 22 and preferably extend to the center of the corner portions 32.

Fasteners, such as the blind rivets illustrated in FIG. 2 which deter disassembly by pranksters, are used to secure the two channels together at a few separated points while permitting the channels to bend along a transverse fold line. The fasteners secure the center portions of the channels together and permit the rest of the channels to move relative to each other. The fasteners preferably only limit the separation of the channels 22 and 24 while permitting them to slide along the ferrule 52 of the fastener and come together when the post is bent, and the channel flatten at the bend situs. The fasteners are preferably of a non-corrosive material such as stainless steel.

When the guidepost is assembled as described above the second channel 24 or damper prevents the front channel 22 from vibrating excessively in the wind. Generally both an axial twisting and a bending type vibration would be otherwise caused by the wind. This vibration, especially when reflectors are used and the posts are made in a preferred highly visible, white plastic, can undesireably distract the motorist, particularly at night. The post is inserted in the ground far enough so that the lower end 54 of the damper 24 which may be shorter than the front channel 22 is imbedded in the ground.

When the guidepost 20 is struck, typically on the face 42, the curved corner portions 32 of the first channel and the arcuate damper 24 flatten out to permit the guidepost to non-destructively bend. These recurve upon the passing of the vehicle and cause the guidepost 20 to re-erect itself.

This form of guidepost will minimize or eliminate any damage to the vehicle that struck it. It will not have to be replaced once it is struck as most rigid guideposts require. Also the guideposts generate a loud noise when striking the underside of a vehicle to awaken a sleeping or inattentive driver.

When the preferred embodiment is constructed from the preferred thermoplastic, polycarbonate resin curved corner portions 32 having a radius less than $\frac{3}{4}$ inch will not work properly. When such radii are used the stresses in the material created when the guidepost is bent results in permanent deformation of the material. A 1" corner radius is preferred. Also when the side portions 30 are omitted the guideposts are generally not stiff enough to give the post a desirable degree of rigidity. Conversely if the side portions are too wide, for example creating a channel deeper than $1\frac{1}{2}$ to 1/38 inches with 1 inch radius corners, say 2 inches deep, the channel becomes too stiff to operate properly.

If 90° corners are used, the corner portions 32 do not start to flatten out when the guidepost first starts to bend. The side portions 30 undergo a compression which results in permanent deformation of the material. The use of an obtuse angle between the side portions 32 and center portion 28 avoid this problem and assure that the corner portions flatten rather than fold.

ANOTHER EMBODIMENT WITH A DAMPER

Figure 4:
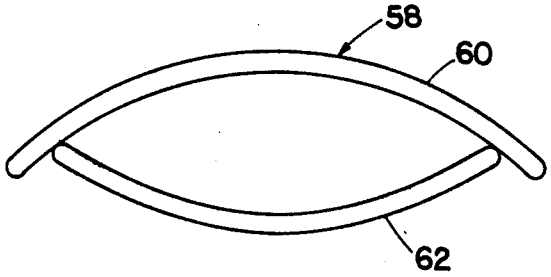
FIG. 4 is a transverse sectional view showing the cross-section of another embodiment of the guidepost with the damper.

FIG. 4 illustrates in cross-section another embodiment of the guidepost 58 where the front channel 60 has an arcuate cross-section as does the damper 62.

ANOTHER EMBODIMENT WITHOUT A DAMPER

Figure 5:
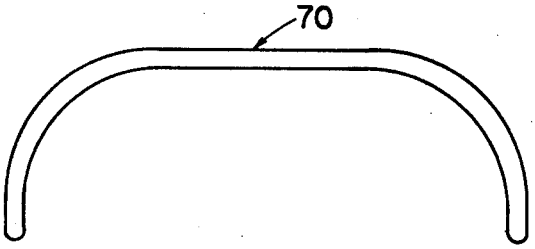
FIG. 5 is a transverse sectional view of another embodiment of the guidepost without a damper.

In some applications, either where the vibration is not bothersome or it is desired a form of the guide post 70, as shown in FIG. 5 may be used. This guidepost has the same configuration as the preferred embodiment, but the damper and fasteners are eliminated.

OTHER EMBODIMENTS

Figure 6:
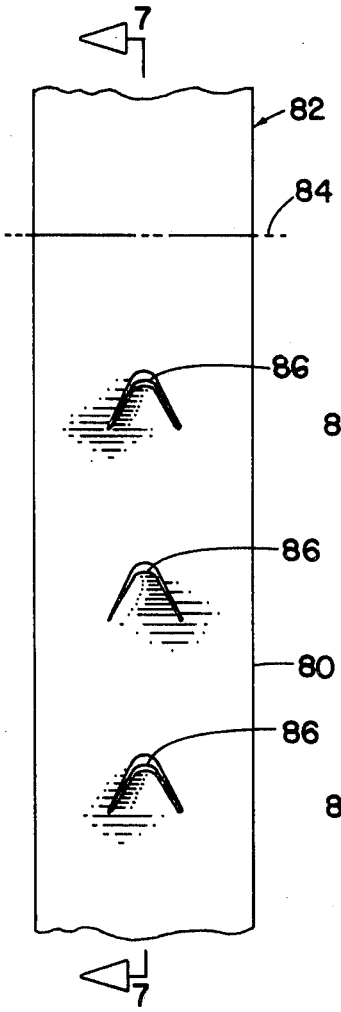
FIG. 6 is a partial front elevation view of a guidepost channel illustrating a barb to retain the guidepost in the ground.
Figure 7:
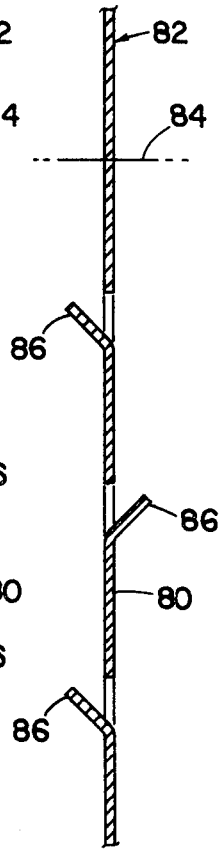
FIG. 7 is a longitudinal section along the lines 7—7 of FIG. 6.
Figure 8:
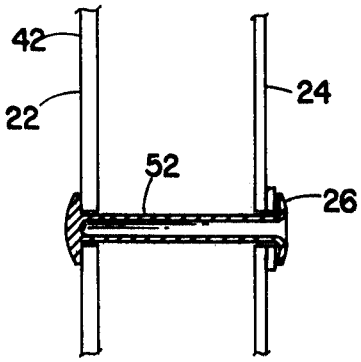
FIG. 8 is a longitudinal section along the lines 8—8 of FIG. 2.

FIGS. 6 and 7 illustrate a further form of the lower end 80 of a guidepost channel 82 which is imbedded below the surface 84. A series of integrally formed barbs 86 are provided to inhibit removal of the guidepost 82 from the ground. The barbs are formed by making V shaped cuts in the channel and bending the resulting tab outward. They may be formed in one operation which includes simultaneously cutting the channel to the desired length from an extruded length of channel material.

ADVANTAGES OF THE INVENTION

The guidepost provides a simple to construct and durable marker with a high visibility. It is self-erecting when struck by a vehicle. It creates a noise which will awaken a sleeping or inattentive driver who strays from the traveled way and is of a construction which avoids damage to the post and to the vehicle.

We claim:

1. A self-erecting highway guidepost comprising: a channel of a flexible, impact resistant plastic material having an elongated substantially flat center portion, one surface of which forms a face of the post; a pair of elongated, substantially flat side portions each flanking opposite sides of the center portion at an obtuse angle to the center portion; a pair of curved corner portions each joining a respective side portion to the center portion so that the side portions give rigidity to the channel maintaining the channel in a substantially linear configuration when it is undisturbed, which corner portions uncurve to permit the channel to nondestructively bend when it is struck on the face side, and which corner portions recurve to erect the post again.

2. A self-erecting highway guide post, as claimed in claim 1, wherein the plastic material is a thermoplastic, polycarbonate resin.

3. A self-erecting highway guide post, as claimed in claim 2 wherein the channel is of a uniform thickness less than 0.140 inch.

4. A self-erecting highway guidepost, as claimed in claim 1, wherein the curved portions are uniformly curved.

5. A self-erecting highway guidepost, as claimed in claim 4, wherein the channel is of a polycarbonate resin material of a uniform thickness less than .140 inch thick having a plurality of holes in one end to prevent removal of the channel once that end is inserted in the ground and comprising in addition a reflective element of reflective tape attached to the face of the channel.

6. A self-erecting highway guidepost comprising:

(a) a first elongated channel of a flexible, impact resistant material having an upper and lower end, the outside surface of the channel forming the face of the post;

(b) an elongated, arcuate cross-sectioned channel within the edges of the first channel with its concave side directed toward the rear surface of the first channel to provide vibration dampening; and (c) means for securing the arcuate channel to the first channel so that the channels may bend transversely to provide a guide post which can be non-destructively bent when struck by a vehicle and right itself with little or no damage to the vehicle.

7. A self-erecting highway guide post, as claimed in claim 6, wherein the first channel has an arcuate cross-section.

8. A self-erecting highway guidepost, as claimed in claim 6, wherein the first channel has an elongated substantially flat center portion, a pair of elongated, substantially flat side portions each flanking opposite sides of the center portion at an an obtuse angle to the center portion, and a pair of curved corner portions each joining a respective side portion to the center portion.

9. A self-erecting highway guidepost, as claimed in claim 8, wherein the arcuate channel is intermediate the curved portions of the first channel to facilitate the bending of the guidepost.

10. A self-erecting highway guidepost, as claimed in claim 8, wherein the arcuate channel has a thinner central cross-section than its edge portions.

11. A self-erecting highway guidepost, as claimed in claim 8, wherein the corner portions of the first channel are uniformly curved.

12. A self-erecting highway guidepost, as claimed in claim 8, wherein the first channel and the arcuate channel are a thermoplastic, polycarbonate resin.

13. A self-erecting highway guidepost, as claimed in claim 23, wherein the channels comprise longitudinal extrusions to provide resistance to fracture on bending and simplicity of manufacture.

14. A self-erecting highway guidepost, as claimed in claim 12, wherein the first channel is of a uniform thickness which is less than 0.140 inch for flexibility.

15. A self-erecting highway guidepost, as claimed in claim 14, wherein the arcuate channel is intermediate to the curved portions of the first channel and has a thinner central cross-section than its edge portions, wherein the lower end of the first channel extends beyond the arcuate channel, and wherein the corner portions of the first channel are uniformly curved.

* * * * *